US005153998A

United States Patent [19]

Duncan

[11] Patent Number: 5,153,998

[45] Date of Patent: Oct. 13, 1992

[54] PANEL CUTTING AND FORMING DEVICE AND METHOD

[76] Inventor: Alonzo C. Duncan, 342 Middlesex St., Gloucester, N.J. 08030

[21] Appl. No.: 692,737

[22] Filed: Apr. 29, 1991

[51] Int. Cl.[5] ..... B26B 29/00

[52] U.S. Cl. ..... 30/310; 30/290; 33/27.01; 33/27.12; 83/565

[58] Field of Search ..... 30/310, 289, 294, 290; 33/27.06, 27.12, 628, 27.01; 83/565, 745, 743, 574, 875

[56] References Cited

U.S. PATENT DOCUMENTS

| | | | |
|---|---|---|---|
| 422,169 | 9/1880 | Lockwood | 30/286 |
| 658,711 | 9/1900 | Forker | 83/565 |
| 660,211 | 10/1900 | Durkel | 30/310 |
| 701,828 | 6/1902 | Arnold | 30/310 |
| 731,066 | 6/1903 | Nye | 33/27.01 |
| 881,899 | 3/1908 | Chapman | 33/27.12 |
| 915,926 | 3/1909 | Allen | 33/27.06 |
| 1,004,157 | 9/1911 | Ferri | 33/27.12 |
| 1,527,763 | 2/1925 | Vance | 83/508 |
| 2,468,504 | 4/1949 | Little | 125/20 |
| 2,491,330 | 12/1949 | Petre | 33/177 |
| 2,943,392 | 5/1960 | Attridge | 30/310 |
| 3,015,889 | 1/1962 | Godman | 33/27 |
| 3,509,631 | 5/1970 | Shimoyama | 33/27 |
| 3,820,245 | 6/1974 | Yozzo | 33/27.01 |
| 4,050,336 | 9/1977 | Stubbings | 30/310 |
| 4,509,398 | 4/1985 | Mason | 83/574 |
| 4,858,322 | 8/1989 | Kluga | 30/310 |
| 4,913,206 | 4/1990 | Altinbasak | 33/27.06 |

FOREIGN PATENT DOCUMENTS

| | | | |
|---|---|---|---|
| 565103 | 7/1923 | France | 33/27 |

OTHER PUBLICATIONS

CertainTeed-Ultra Duct Fiber Glass Board Fabrication Instruct. 1987.

*Primary Examiner*—Frank T. Yost
*Assistant Examiner*—Hwei-Siu Payer
*Attorney, Agent, or Firm*—Lennox, Thomas A.

[57] ABSTRACT

A porous panel cutting and forming device and method is provided including a support and guide block with an "L" shaped guide slot into which a pivot guide pin is inserted depending downwardly from a radial arm with a knife blade depending from an end. The arm member is pushed or pulled along the slot to cut the straight edge and then rotated ninety degrees while the guide pin remains relatively stationary in the guide slot, followed by movement of the arm member along the straight section of the slot to finish the cut forming a top or bottom panel section of a ninety degree angle curved heating and air conditioning duct section. The back of the duct section to be attached to the curved portion of the corner is formed in a curved shape after cutting parallel slits one inch apart transverse across the panel at a forty-five degree angle to the surface.

14 Claims, 7 Drawing Sheets

PANEL CUTTING AND FORMING DEVICE AND METHOD

BACKGROUND OF THE INVENTION

This invention involves cutting and forming panels. More specifically, it involves cutting porous panels, including fibrous reinforced panels and forming them to arcuate shapes. It specifically involves a cutting device and a method of cutting arc shapes out of porous panels. It specifically involves the method of forming and bending flat panels into a curved shape.

In the building and construction field there are a large number of relatively porous panels used in a variety of applications. These panels include rigid and semi-rigid polymeric foam panels, generally with one or more paper, plastic or metal film surfaces adhered to a surface. Also included in this general grouping are particle boards which are low pressure laminates of cellulosic fibers bound together, generally for indoor usage. Of particular interest are low pressure fiberglass reinforced laminates generally known in the field as "duct board" supplied commercially by CertainTeed Corporation, Mansville Corporation and Owens-Corning Fiberglass Corporation. The duct board is formed of glass fiber mat bound with little or no pressure together with an adhesive resin material to form a rigid panel board with an aluminum foil sheet bonded to one surface. An example of this material ULTRA* DUCT FIBER GLASS BOARD supplied by CertainTeed Corp., P. O. Box 860, Valley Forge, Pa. 19482. This material is used to construct residential and commercial heating and air conditioning ducts. The aluminum foil is positioned on the outside of the constructed duct section and flax extensions of the foil are used to overlay and allow attachment of the panels of the duct board together using staples. The ducts usually range in size from about eight inches by eight inches to about ten inches by thirty inches. The individual panels of duct board are attached end to end generally using male and female ship lap joints with the aluminum foil, staples, and duct tape to form the duct which is held in position by metal straps and trapeze hangers. This type of construction has largely replaced the metal duct work of the past, particularly in residential buildings.

When the duct work constructed of duct board is required to turn a corner, either horizontally or vertically, a problem has arisen. Metal duct work was bent and formed to form curved corners to minimize pressure drop and interference with the air flow. The square corner sections constructed of duct board had unsatisfactory flow characteristics as the air banged against the end of the corner which was normal to the air flow thus causing a substantial pressure drop and reduction in air flow. The solution to this problem has been to insert a baffle plate at a forty-five degree angle across the corner inside the duct corner section. This baffle plate includes small air scoops which are curved to catch the air and throw it around the corner in the new direction. This baffle plate must be inserted and attached inside the duct board corner section after it has been constructed. Since the duct board duct section is only marginally structural in nature, expensive and time consuming attachments are necessary to insert and retain the turning-vane device. Further, the air flow is substantially disrupted and the system is only marginally effective in reducing the pressure drop as the air flow turns the corner.

No satisfactory system or device has been disclosed or made available to satisfy the above problems or to achieve the objects described hereinbelow.

SUMMARY OF THE INVENTION

The device and method of the present invention is effective to cut, shape and form any and all of the various panels constructed of rather porous and low density materials that are capable of being cut with sharp knife. Thus, while most of the specification is directed to the use of the device and methods on duct board, this merely illustrates the use of the device and methods for use on various porous panels. Thus, the device and methods described herein are effective to form structures of rigid and semi-rigid foam panels and of light pressure adhesive bound porous cellulosic panels.

The duct board does not lend itself to easy forming or cutting into irregular and curved shapes. It is not easy to cut the duct board into a shape that would form the top or the bottom of a horizontal curved angled duct section. The curved shape of a right angle bend duct shape would require careful measurement and layout on the panel then require exact duplication of that shape for the opposite side of the right angle bend duct. What is needed is a device that a duct worker in the field can easily, with minimal measurements, cut the various panel shapes and form those panels to construct a curved duct section out of the duct board. It is an object of this invention to provide such a device and methods.

It is a specific object of this invention to provide a cutting device and method to allow accurate and reproducible cutting of a ninety degree are cut with adjustable length throat sections which can be used on the top and bottom of horizontal right angle turn duct sections. These ninety degree arc sections also require a formed back panel that bends around the curve on the outside to form even air flow to turn the corner.

It is a specific object of the present invention to provide a cutting device and method to allow the hand cutting with essentially no measurements or markings on the panel of reproducible ninety degree arc cuts across a porous panel.

It is also an object of the present invention to provide a device and method to form T-shaped duct sections wherein the air flow is divided and allowed to flow around a curved surface in opposite directions either to a duct section of the same size as the entry section or of differing sizes.

It is a further object of the present invention to provide a device and method to produce a duct section in the form of a side outlet key wherein the flow is allowed to flow out of the main section into a side duct section along a curved surface to facilitate air flow into the side outlet.

It is a particular object of the present invention to provide a device and method to produce ninety degree L-shaped duct sections wherein the lengths of the throats may differ in length.

It is an additional object of the present invention to provide a method for forming a panel into a curved shape. If a porous panel, such as rigid foam or duct board, is bent into an arc shape of about ninety degrees, it tends to either break or bend at a particular point rather than to form a gentle curve. The technique of making a multiplicity of notch cuts transverse to the bend of the panel on the inside surface of that bend is well known. However, to cut notches or make transverse saw cuts or in any way to remove material from the inside surface of the panel to be bent is time consuming and wasteful. It is therefore an object to provide a method to quickly allow rigid foam and duct board as well as other like materials to be bent in a gentle arc of at least ninety degrees.

An aspect of the invention is a cutting apparatus to cut an arc shaped cut through a panel that includes a cutting device. The cutting device includes an arm member that includes a length having a first end and a second end, a top surface facing upwardly, and a bottom surface facing downwardly. The cutting device further includes a pivot guide member depending downwardly from the bottom surface of the arm member, a first gripping member extending upwardly from the upper surface of the arm member proximate the pivot guide member, and a fixing means to allow positioning the pivot guide member and the first gripping member along the length of the arm member at a chosen position and to releasably fix the pivot guide member and the first gripping member at the chosen position. The cutting device also includes a second gripping member attached to the arm member and extending upwardly from the upper surface of the arm member proximate the second end, and cutting means detachably attached proximate the second end and defining a cutting edge depending downwardly from the bottom surface of the arm member preferably to make a line cut perpendicular to the bottom surface of the arm member and to the length of the arm member. The cutting apparatus includes a guide device that includes a block member includes a top surface, and a bottom surface, and fastening means to fasten the block member to a top surface to the panel to prevent horizontal movement of the block relative to the panel . The guide device further includes a slot cut out from the top surface of the block member with a depth toward the bottom surface of the block member. The slot includes a first section of the slot extending from a first end of the first section of the slot to a second end of the first section of the slot, including a first straight line direction, a second section of the slot extending from a first end of the second section of the slot to a second end of the second section of the slot, including a second straight line direction prependicular to and directed at the first straight line direction proximate the second end of the first section of the slot, and an intersecting section of the slot joining the second ends of the first and second sections of the slot. The slot has a width sufficient to receive the pivot guide member and allow the guide member to freely slide along the length of the slot.

It is preferred that the fastening means include a plurality of pointed member attached to the block and depending downwardly from the bottom surface of the block member. It is further preferred that the fastening means include a multiplicity of pointed metal spikes. It is also preferred that the slot in the block member be "L" shaped. It is further preferred that the intersecting section of the slot incude a curved arc direction. It is more preferred that the curved arc direction of the slot include a partial circle. It is further preferred that the first straight line section of the slot be parallel to an edge of the block member. It is also preferred that the clot include a first straight line section extending from a point proximate the first side edge toward the second side edge, and parallel to the upper edge, a second straight line section extending from a point proximate the lower edge toward the upper edge and parallel to the second side edge, and an arc section joining ends of the first and second straight line sections at median points along the upper edge and the second side edge. It is further preferred that the arm member further include a section of the arm member extending from the first end to a median position defining an upper plane of the bottom surface, and an end section of the arm member proximate the second end defining a power plane of the bottom surface parallel to upper plane of the bottom surface. It is also preferred that the fixing means include a slot cut lengthwise along the arm member of sufficient width to receive a section to the pivot guide member, a plate member positioned on the top surface of the arm member, wherein the first gripping member is rigidly attached to the plate member extending upwardly and the pivot guide member is rigidly attached to the plate member extending downwardly through the slot through the arm member, and means to releasably fix the plate to the arm member to position the pivot guide member at the chosen position.

Another aspect of the invention is a cutting apparatus to cut an arc shaped cut that includes a cutting device and a guide device that includes a block member includes a top surface, a bottom surface, an upper edge, a lower edge, a first side edge, and a second side edge, and a plurality of pointed member attached to the block and depending away from the bottom surface of the block member. The guide also includes an "L" shaped slot cut out from the top surface of the block member with a depth toward the bottom surface of the block member, wherein a line direction of an arm of the slot extending from an edge of the block toward the apex of the slot is perpendicular the said edge, and wherein the slot has a width sufficient to receive the pivot guide member and allow the guide member to freely slide along the length of the slot. Another aspect of the invention is a method using a person's hands to cut an arc shaped cut through a panel that includes providing a cutting device. The cutting device includes an arm member includes a length having a first end and a second end, a top surface facing upwardly, and a bottom surface downwardly, a pivot guide member depending downwardly from the bottom surface of the arm member, a first gripping member extending upwardly from the upper surface of the arm member proximate the pivot guide member, fixing means to allow positioning the pivot guide member and the first gripping member along the length of the arm member at a chosen position and to releasably fix the pivot guide member and the first gripping member at the chosen position. The cutting device also includes a second gripping member attached to the arm member and extending upwardly from the upper surface of the arm member proximate the second end, and cutting means detachably attached proximate the second end includes a cutting edge depending downwardly from the bottom surface of the arm member to make a line cut perpendicular to the bottom surface of the arm member and to the length of the arm member. The method also includes providing a guide device that includes a block member includes a top surface, a bottom surface, an upper edge, a lower edge, a first side edge, and a second side edge, and fastening means to fasten the block member to a top surface to the panel to prevent horizontal movement of the block relative to the panel. The guide device also includes a slot cut out from the top surface of the block member with a depth toward the bottom surface of the block member. The slot includes a first section of the slot extending from a first end of the first section of the slot to a second end of the first section of the slot, includes a first straight line direction, a second section of the slot extending from a first end of the second section of the slot to a second end of the second section of the slot, includes a second straight line direction perpendicular to and directed at the first straight line direction proximate the second end of the first section of the slot, and an intersecting section of the slot joining the second ends of the first and second sections of the slot. The slot has a width sufficient to receive the pivot guide member and allow the guide member to freely slide along the length of the slot. The method further includes placing the block member with the bottom surface facing downwardly toward the top of a panel to be cut, and exerting sufficient pressure on the block member to cause the fastening means to fasten to the panel. The method also includes placing the cutting device on top of the block member engaging the pivot guide member in the slot at the first end to the first section of the slot with the arm member positioned perpendicular to the first straight line direction, and grasping the first and second gripping members with the hands and moving the cutting device toward the second end of the first section while maintaining engagement of the pivot guide member in the first straight line section of the a lot and while maintaining the arm member in perpendicular alignment to the first straight line section of the slot. When the pivot guide member reaches the intersecting section of the slot, the method further includes horizontally rotating the second gripping member toward the first end of the second straight section of the slot, while maintaining guide member in the intersecting section of the slot until the arm member is positioned perpendicular to the second straight line section of the slot. The method further includes moving the first and second gripping members of the cutting device with the hands toward the first end of the second straight section of the slot while maintaining engagement of the pivot guide member in the second straight line section of the slot and while maintaining the arm member in perpendicular alignment to the second straight line section of the slot.

Another aspect of the invention is a method of forming a porous panel to an arc shape that includes providing a panel that includes panel composition and structure sufficient that a knife edge will readily cut through the panel, an impervious flexible film adhered on a top surface of the panel, and a bottom surface, a length, two opposite end edges, and two opposite side edges. The method further includes cutting a multiplicity of cuts through the panel material, the cuts being cut from the bottom surface toward the stop surface to a depth approaching the film, being straight of a length from side edge to side edge, being spaced apart from each adjacent cut along the length of the panel, and being cut at a plane at an angle ranging between about thirty degrees and about seventy degrees with the top surface. The method further includes bending the panel bringing the end edges closer together with the top surface on the convex side. It is preferred that the panel be duct board.

DESCRIPTION OF PREFERRED EMBODIMENTS

Figure 1:
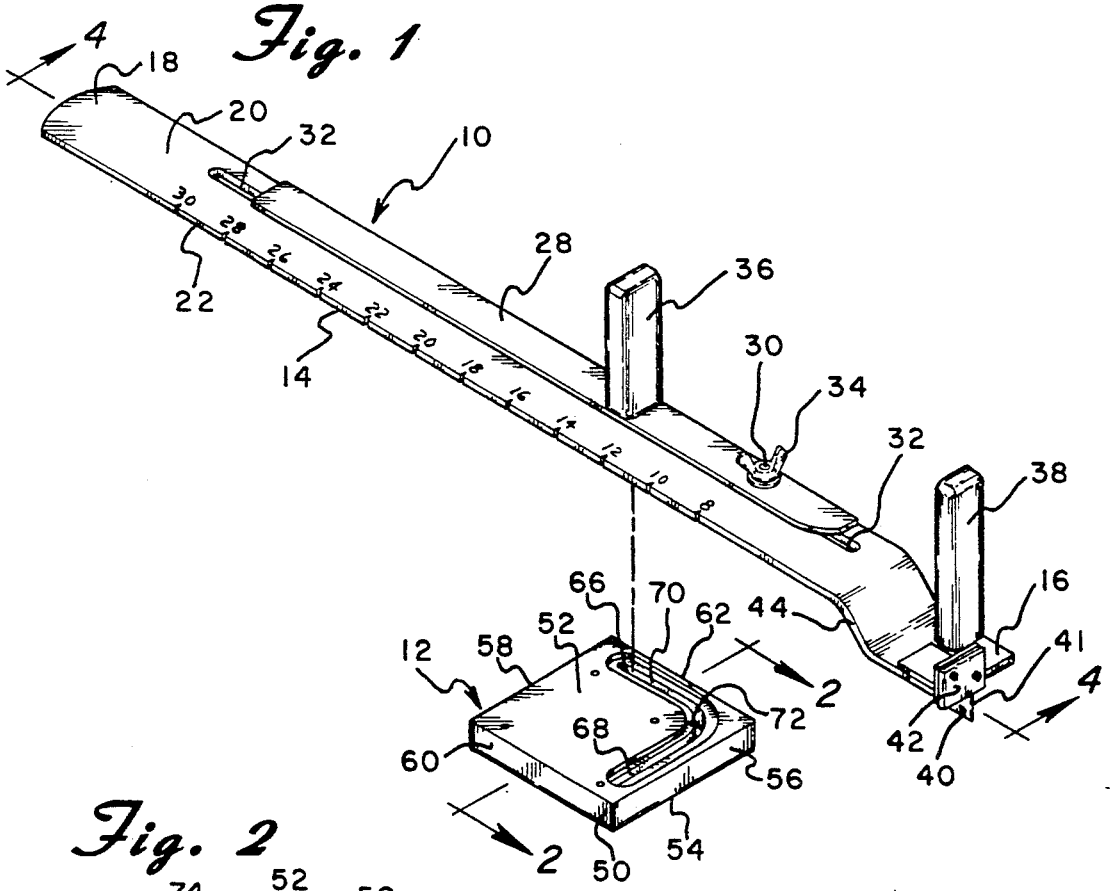
FIG. 1 is a perspective view of a cutting apparatus of the present invention.
Figure 2:
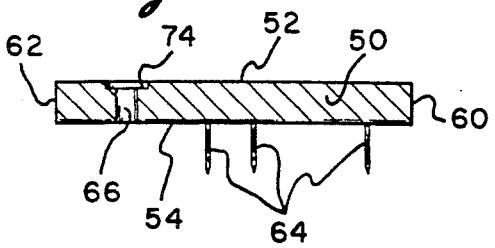
FIG. 2 is a cross-sectional view taken along lines 2—2 of FIG. 1.
Figure 3:
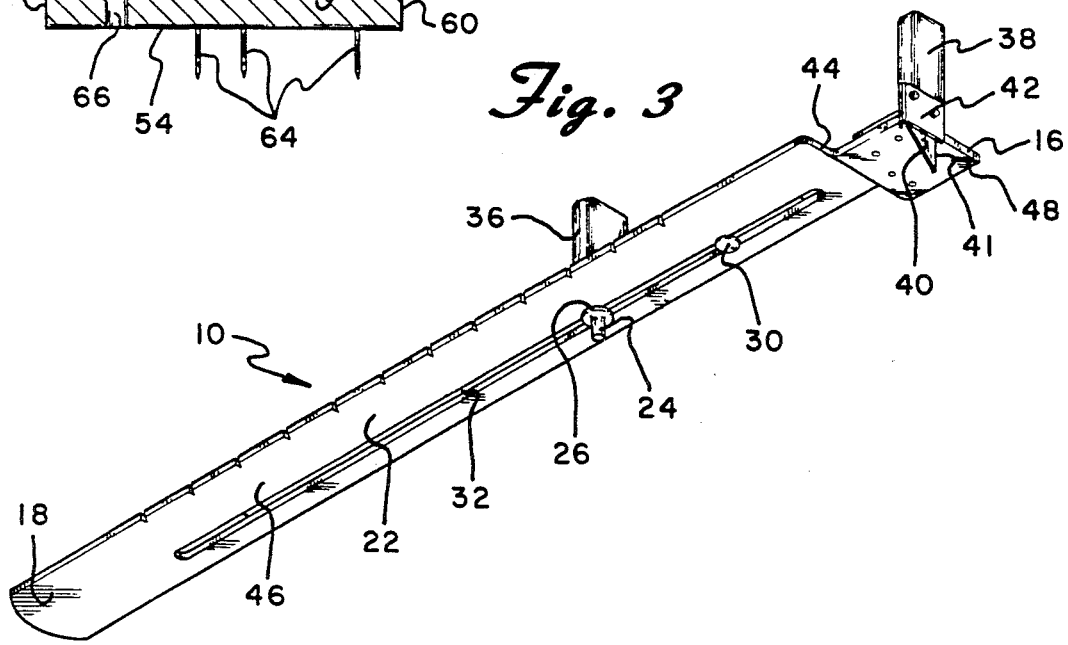
FIG. 3 is a bottom perspective view of the cutting device illustrated as part of the apparatus in FIG. 1.
Figure 4:
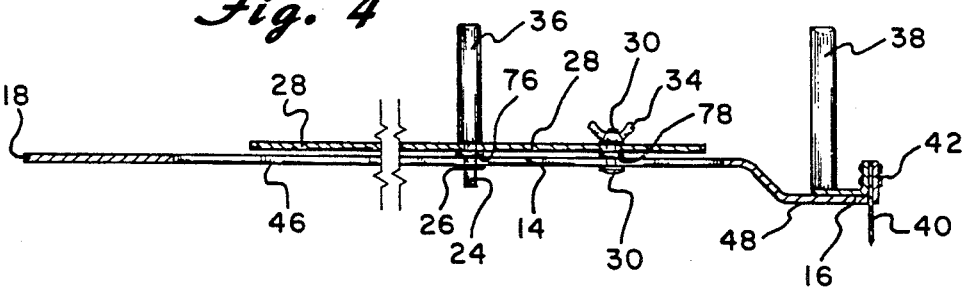
FIG. 4 is a cross-sectional view taken along lines 4—4 of FIG. 1.

A cutting apparatus of the present invention is illustrated in FIG. 1 including device 10 and guide device 12. Cutting device 10 includes base arm member 14 constructed of one-eight inch steel plate abot thirty-six inches long and about four inches wide. The length extends from first end 16 to second end 18 with top surface 20 and bottom surface 22. Pivot guide pin 24, as shown in FIG. 3 depends downwardly from bottom surface 22 through slide slot 32 with integral radial flange 26 engaging bottom surface 22 outside of slide slot 32 which extends a major portion of the length of arm member 14. Guide adjustment plate 28 is positioned on top surface 20 and is about twenty-four inches long and about one and one-half inch wide. Bolt 30 extends through slide slot 32 and through a hole in guide adjustment plate 28 with wing nut 34 threadably engaged on the threaded end of the bolt on the top of plate 28. Pivot guide pin 24 is structurally attached to and depends downwardly from plate 28. Pin 24 slides freely along slide slot 32 so that plate 28 is also free to slide lengthwise along slot 32. Pivot guide pin 24 may be positioned at any chosen location along slot 32 and secured in place by tightening wing nut 34 to effectively make the arm member and guide adjustment plate a single unit. First gripping member 36 is a vertical handle constructed of wood structurally attached to the top of guide adjustment plate 28 and extending upwardly directly above pivot guide pin 24. Second gripping member 38 is of similar construction and is securely attached to and extending upwardly proximate first end 16 of arm member 14. Knife 40, with cutting edge 41, depends downwardly from bottom surface proximate end 16 and is detachably attached by plate 42 held in place by two threaded nuts and bolts. The plane of the knife is perpendicular to the length of base member 14 and to the bottom surface of device 10. While the cutting edge may be angled it is preferred that it be perpendicular to the bottom surface. As more clearly shown in FIG. 3, angled section 44 of arm member 14 brings lower plane 48 of bottom surface 22 proximate end 16 to a level lower than the upper plane 46 of bottom surface 22. This angle is used to bring knife 40 in close proximity and in contact with the panel to be cut when the upper plane of bottom surface 46 is resting on guide device 12. Guide device 12 includes block member 50 which is a block of one inch thick hard wood about six inches square. Block member 50 includes top surface 52, bottom surface 54, upper edge 56, lower edge 58, first side edge 60 and second side edge 62. Pointed pin members 64, being **10*d* nails, depend downwardly from bottom surface 54. Slot 66 is routed out of top surface 52 toward bottom surface 54. As shown here, slot 66 is cut all the way through from the top surface to the bottom surface, but it need be no deeper than sufficient to receive pivot guide pin 24. Slot 66 includes first straight section 68 extending from first side edge 60 toward second side edge 62 proximate upper edge 56. Slot 66 also includes second straight section 70 extending from lower edge 58 toward upper edge 56 proximate second side edge. First section 68 and second section 70 are joined by arc connecting section 72 which joins the ends of first and second sections proximate the corner between upper edge 56 and second side edge 62. As shown in FIG. 2, slot 66 is sufficient to receive pivot guide pin 24 with the slot widened proximate top surface 52 to slot 74 which is a wide shallow slot to receive radial flange 26 as pivot guide pin 24 slides along the slot. As shown in FIG. 4, guide adjustment panel 28 slides along steel washer 76 around pivot guide pin 24 and steel washer 78 around bolt 30, both sandwiched between panel 28 and base arm member 14**.

Figure 5:
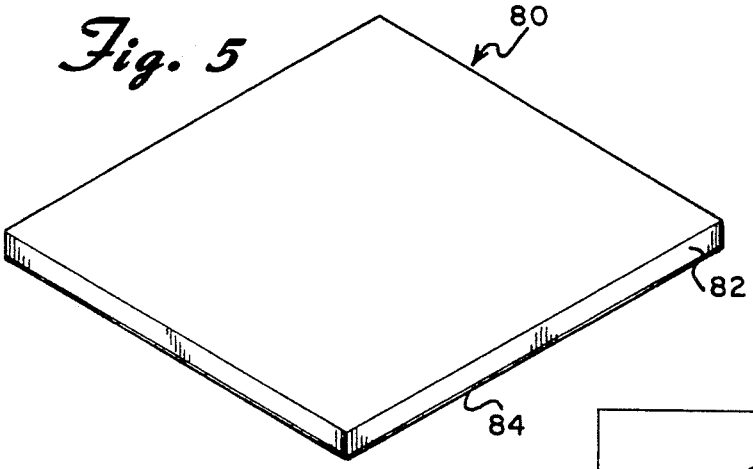
FIG. 5 is a perspective view of a duct panel to be cut using the present invention.
Figure 7:
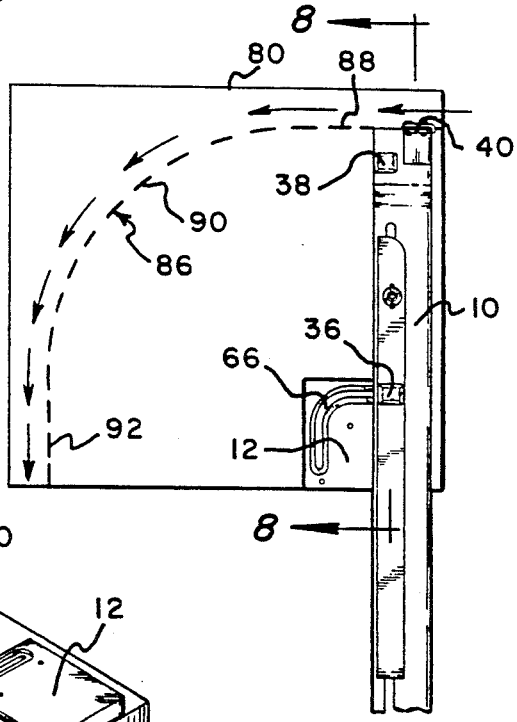
FIG. 7 is a top plane view looking downwardly on the panel and guide device illustrated in FIG. 6 onto which has been placed the cutting device showing the direction of movement and cut.
Figure 6:
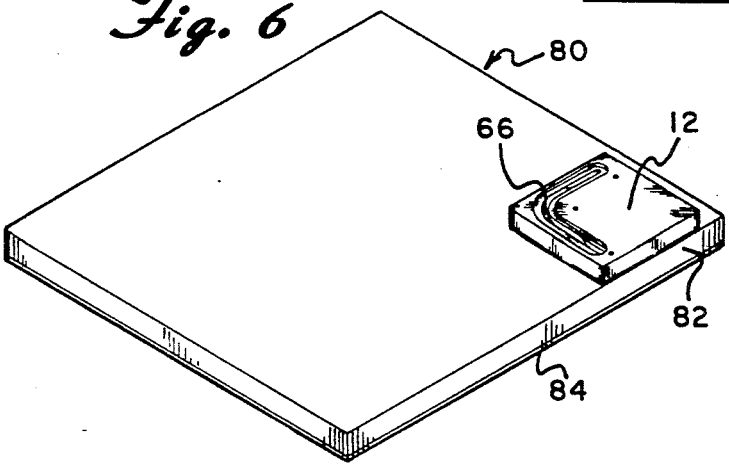
FIG. 6 is a perspective view of the duct panel with the guide device illustrated in FIG. 1 impaled thereon.
Figure 7A:
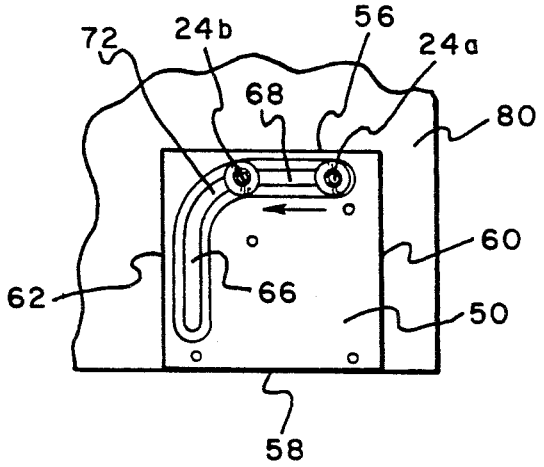
FIG. 7*a* is a diagram showing a partial top plane view of the guide device on a portion of the panel showing movement of the pivot guide member through a first step in the cutting process from the starting position to a median position at the arc section of the slot.
Figure 7B:
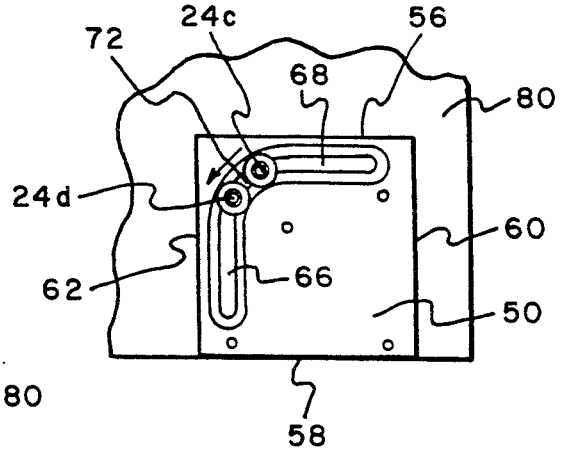
FIG. 7*b* is a view similar to that of FIG. 7*a* showing movement of the pivot guide member during the second phase of the cutting process through the arc section of the slot.
Figure 7C:
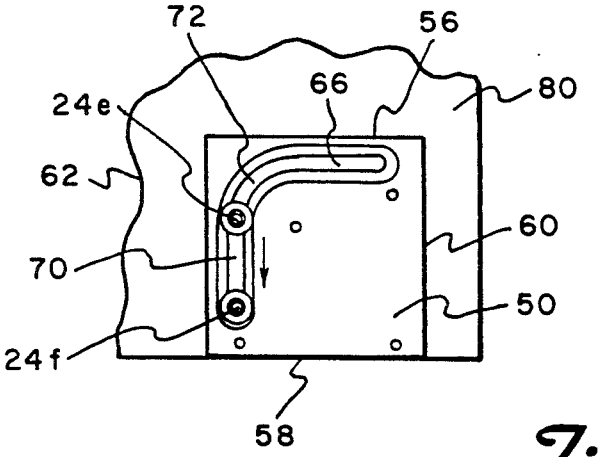
FIG. 7*c* is a view similar to that of FIGS. 7*a* and 7*b* showing movement of the pivot guide member through the last phase of the cutting process.
Figure 8:
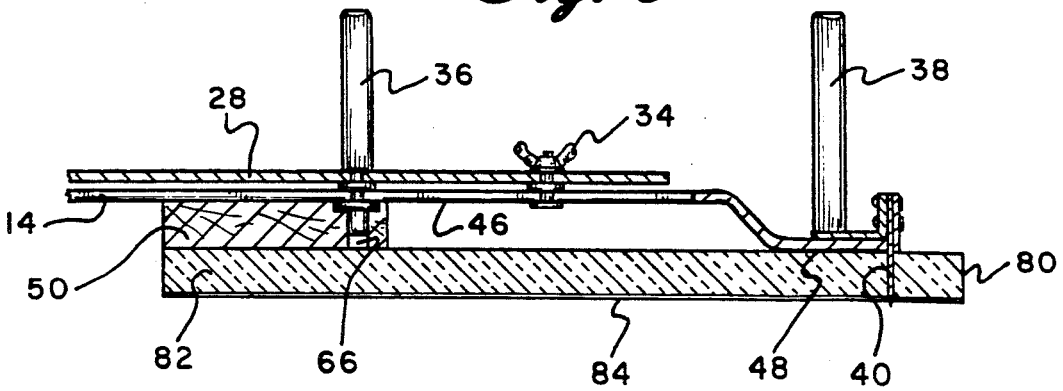
FIG. 8 is a cross-sectional view taken along lines 8—8 of FIG. 7.

In FIG. 5, panel 80 of Ultra duct board from Certain-Teed is illustrated with a bound glass fiber porous body 82 faced on the bottom surface with sheet 84, a sandwich of aluminun foil and paper reinforced with crossing glass fiber strands. In FIG. 6, guide device 12 has been placed on the top surface of panel 80 and pressed downwardly to impale nail pins 64 into duct board body 82. Slot 66 is positioned such that its "L" shape opens toward the corner of panel 80 where device 12 is placed. In FIG. 7, cutting device 10 has been placed on top of guide device 12 engaging pivot guide pin 24 in slot 66 at the end closest to first side edge 60. In this position, the cutting of the arc shaped cut 86 will begin, first by making straight cut 88, then arc cut 90 and finishing with straight cut 92. As shown in FIG. 8, pivot guide pin 24 is engaged in slot 66 placing lower plane 48 of bottom surface 22 against the top of panel 80 allowing knife to cut downwardly and through the entire thickness of panel 80 as the knife is moved through the panel. Cutting device 10 is grasped with the hands on gripping members 36 and 38 exerting downward pressure to maintain engagement of pin 24 in slot 66 and horizontal pressure to make the cut. As illustrated in FIG. **7*a*, the first phase of the cut moves guide pin 24 from position 24*a* to position 24*b* along straight line section 68 of slot 66 from first side edge 60 toward second side edge 62 along upper edge 56 of block 50. During the movement of guide pine 24 from position 24*a* to position 24*b*, arm member 14 is maintained in a perpendicular relationship to straight section 68 by pulling or pushing gripping members 36 and 38 in concert in the same direction with balanced pressure to make cut 88 shown in FIG. 7. When guide pin 24 reaches position 24*b*, the operator feels the guide pin meets connecting section 72. At the stage, side ways pressure on first gripping member 36 is reduced or even terminated while horizontal pressure is still exerted against second gripping member 38 causing end 16 of arm member 14 to rotate in an arc around pivot guide pin 24 which is allowed to move slightly as illustrated in FIG. 7*b* from position 24*c* to position 24*d* to make arc cut 90 as shown in FIG. 7. When end 16 has been rotated ninety degrees such that arm member 14 is now in parallel relationship with straight section 68 of slot 66, pivot guide pin 24 has moved to position 24*e*. At that stage, horizontal pressure is exerted according to the arrow in FIG. 7*c* on both gripping members 36 and 38 maintaining arm member 14 in a perpendicular relationship with straight line section 70 of slot 66 moving guide pin 24 to position 24*f* making straight line cut 92 as shown in FIG. 7**.

Figure 9:
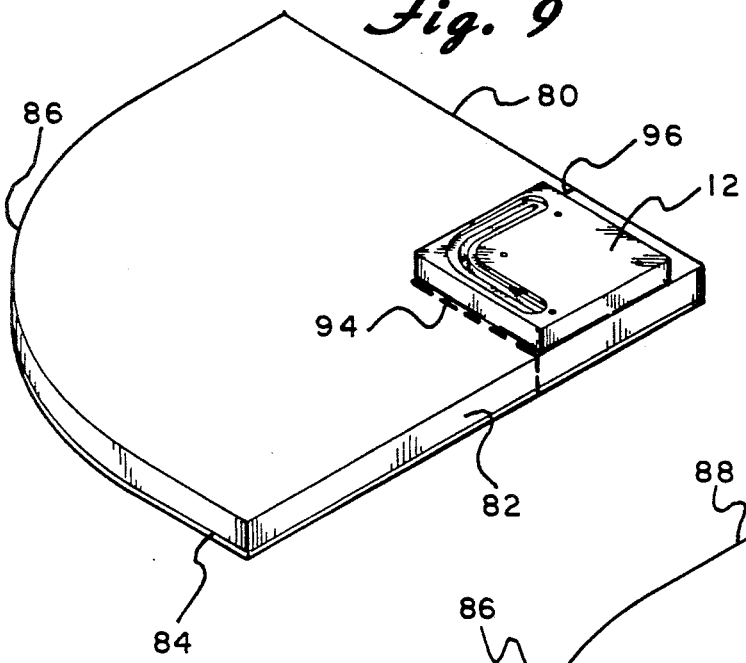
FIG. 9 is a perspective view of the panel and guide device in position to make the cut out of the throat section of the panel as illustrated.
Figure 10:
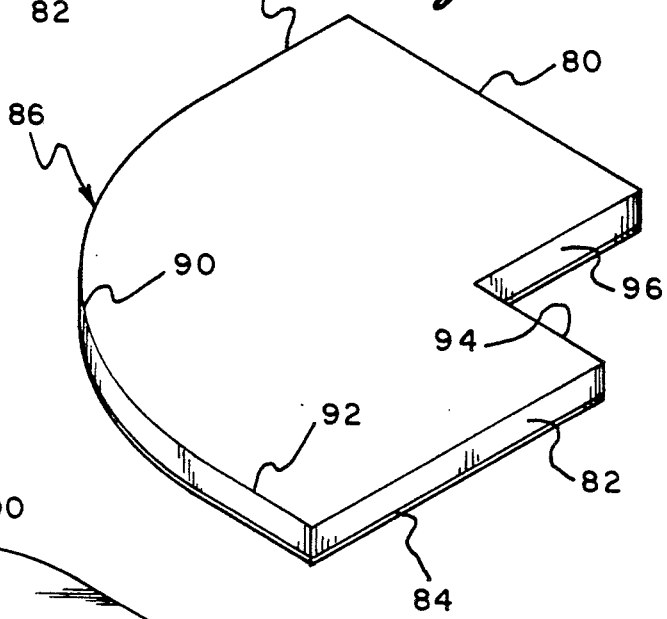
FIG. 10 is a perspective view of the panel as cut using a device and method of the present invention.
Figure 11:
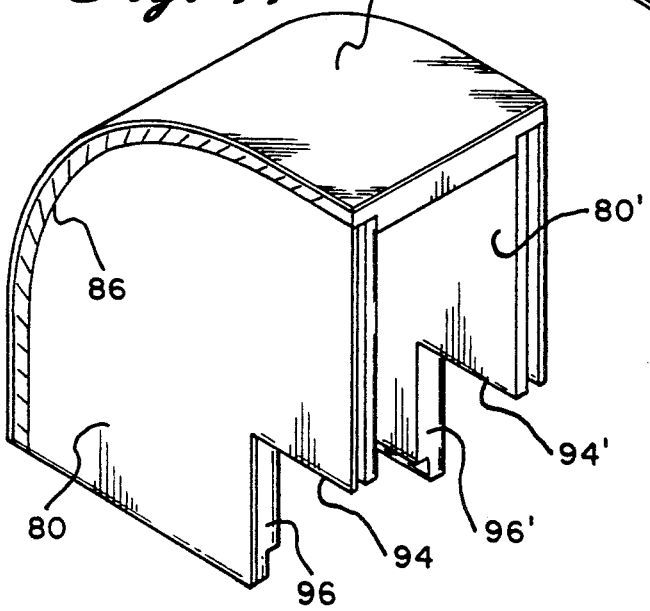
FIG. 11 is a perspective view of a ninety degree angle duct section using the panel and forming methods of the present invention.

As illustrated in FIG. 9, guide device 12 may be used as a cutting guide to cut throat cuts 94 and 96 to finish panel section 80 as shown in FIG. 10. Panel 80 and identical panel 80' are shown in FIG. 11 attached to back panel 100 which partially closes the ninety degree ELL duct section. Although not shown, additional duct panel sections are used to span the area between edges 96 and 96' as well as edges 94 and 94' to complete the duct section. FIG. **12*a* is a top perspective view of panel 115 on which guide device 114** as fastened to the corner which will be the throat section of the ELL duct section. The panel to be cut will form the top or the bottom of an ELL duct section placed in a horizontal position.

Figure 12:
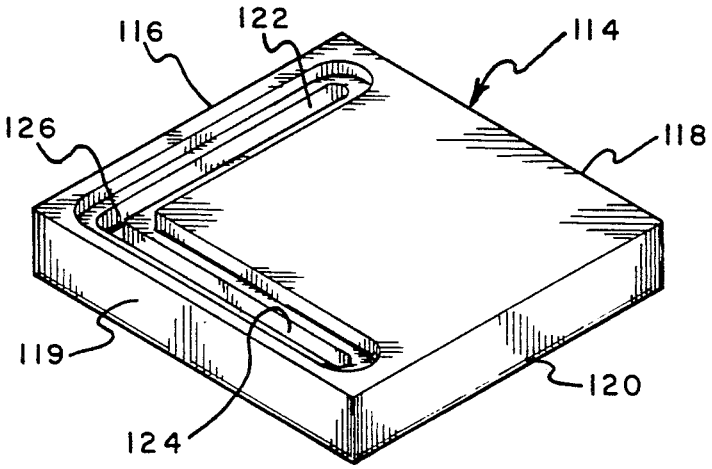
FIG. 12 is a top perspective view of a preferred embodiment of a guide device of the present invention.
Figure 12A:
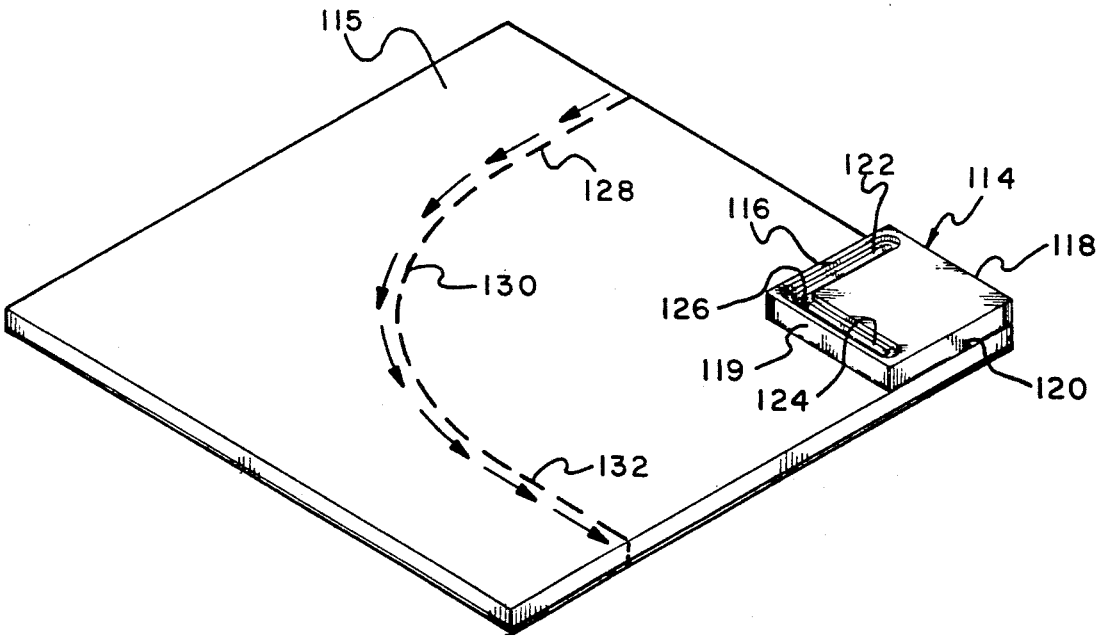
FIG. 12*a* is a top perspective view looking downwardly on a panel with a second embodiment of a guide device fastened thereon with a diagram showing the shape and direction of cut for a ninety degree ELL.
Figure 13:
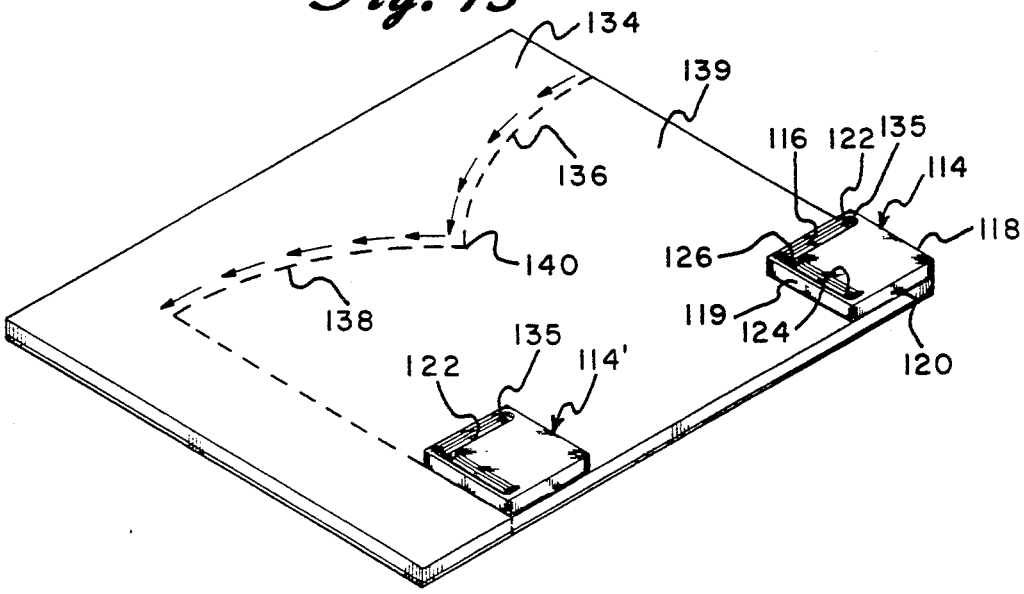
FIG. 13 is a top perspective view of a panel with the guide device illustrated in FIG. 12 fastened in two positions to cut a panel for a tee shaped duct section.
Figure 14:
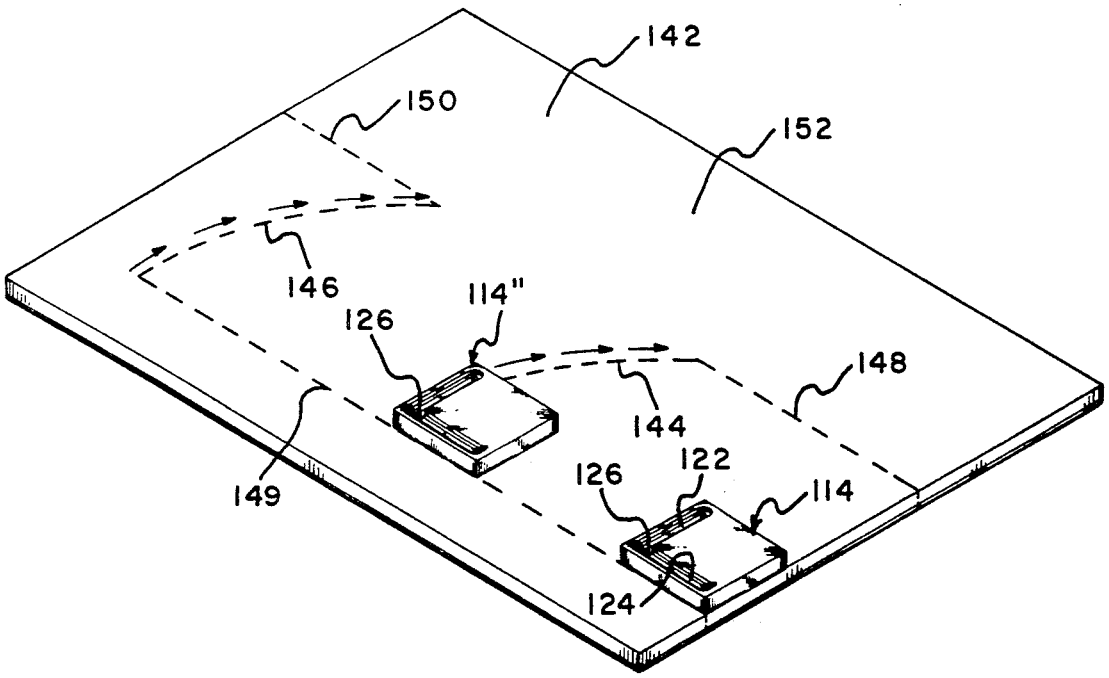
FIG. 14 is a top perspective view of a panel with the guide device illustrated in FIG. 12 fastened in two positions to cut a panel for a side outlet tee shaped duct section.

FIG. 12 is a top perspective view of guide device 114, a preferred embodiment wherein the intersecting section of the guide slot is a junction of the two straight line sections which intersect at the junction. In guide device 114, the guide slot is an "L" shaped slot of sufficient depth to receive pivot guide pin 24. The "L" shaped guide slot of device 114 opens toward the corner of the panel which will be the throat of the "L" shaped section. The guide slot includes first straight line section 122 extending from right side 118 of guide device 114 and extending along top edge 116 toward left side edge 119 of the guide device. The guide slot also includes straight line section 124 which extends from a position proximate lower edge 120 toward top edge 116 parallel to left side edge 119. Slot sections 122 and 124 meet at intersection 126 opening in both directions and constituting the connecting section and corner of the "L" shaped slot. The balance of device 114 is identical to guide device 12. Using this embodiment of the guide device, cutting device 10 is positioned perpendicular to section 122 of the guide slot with pivot guide pin 24 in that section of the slot closest to right side edge 118 of guide device 114. Maintaining cutting device 10 in that perpendicular relationship and gripping hand grip members 36 and 38, knife edge 41 is moved into panel 115 and moved in a straight line to make straight line cut 128 through the panel. When pivot guide pin reaches connecting section 126, pivot guide pin is held in that position with hand grip 36 while hand grip 38 is moved in an arc making arc cut 130 until device 10 is in a parallel relationship to section 122 of the guide slot and in a perpendicular relationship with second straight section 124 of the guide slot. Maintaining that perpendicualar relationship, cutting device 10 is moved in a horizontal direction toward lower edge 120 of the guide device making straight cut 132 to complete the cut. In FIG. 13, the versatility of the device and method is illustrated in the forming of a "T" shaped duct section. Panel 134 is cut with guide device 114 first placed in the lower right hand corner. Cutting device 10 is placed on top of the guide device with pivot guide pin 24 positioned in first section 122 of the guide slot at point 135 which is the first position closest side edge 118 of guide device 114. While maintaining the pivot guide pin at that position, arc cut 136 is cut in panel 134 to median intercept point 140. Guide device 114 is then unfastened from the surface of panel 134 and re-positioned at position 114'. Guide device 114 is not rotated and is maintained at the lower edge of panel 134. Device 114 is re-fastened and the pivot guide pin of cutting device 10 is inserted at point 135 in slot section 122. A second arc cut 138 is made from intercept point 140 to the edge of panel section 139 which will be used to produce the "T" shape. Throat cuts are cut around the top and side edges of guide device 114 at each position to form the panel section. Section 139 is used to form a "T" shape wherein the air will be entering from the lower edge and approaching intercept point 140. When reaching that point, the air will be divided and will flow in both directions ninety degrees from the entry direction. An identical panel 139 will form the opposite wall of the duct section and flat or curved panels will be joined at the corners to produce the duct section using standard methods. In FIG. 14, another way the device and method of the present invention is illustrated. In this illustration, panel 142 is being cut to form a side outlet "T", in this case, a left hand version. In this type of duct, the air is travelling along a straight duct and a side section is provided so that a portion of the air can flow into that side section. If the side section is formed of walls which are flat and joined at ninety degrees to the main section, air flow into that side section of the duct is restricted. On the other hand, if the side walls are curved and cupped toward the direction the flow is coming from, the pressure drop within the duct is reduced. In FIG. 14, air is entering at the lower right edge of panel section 152 and is flowing upwardly and also to the left around the curved surfaces to the side duct section. To produce this left hand panel, which is joined with a mirror image right hand panel section on the opposite side of the "T" duct section, the device and method of the present invention are used. Guide device 114 is fastened to top surface of panel 142 on the bottom edge of the panel and on line 149 at a distance from the left side of the panel to provide the width of the main duct and a curved joining section of the "T" shape. The pivot guide pin 24 of device 10 is inserted at intersection point 126 in the guide slot. Arc 144 is cut to the right to a point on line 149 which is the width of the main duct. The guide device 114 is moved to position 114'' and again pivot guide pin 24 is positioned at point 126 and arc 146 is cut again from the left hand edge to the edge of the main duct on line 150. The diameter of this latter arc cut is adjusted to the width of the side duct section desired. Straight cuts along lines 148, 149, and 150 free panel section 152. Thus, it is possible to use different arc radii on the same panel section, but since the mirror image right hand panel section will have matching arc diameters, it will form an effective duct section. These examples illustrate only a few of the possible combinations and duct sections that can be produced with the device and method of the present invention. For example, the width of the arms in a "T" shape, such as illustrated in FIG. 13, need not be the same width. In order to reduce the width of one of the side duct sections, guide device 114 is merely positioned off the corner and up a measured distance on the right side or left side edge of panel 134. When the arc cut is made, a smaller size side arm duct section will be formed reducing the air flow in that direction. Where possible, it is always preferred that cutting device 10 be used by pulling the cutting edge toward the person. However, it can also be pushed either to make a straight cut or to make an arc cut.

Figure 15:
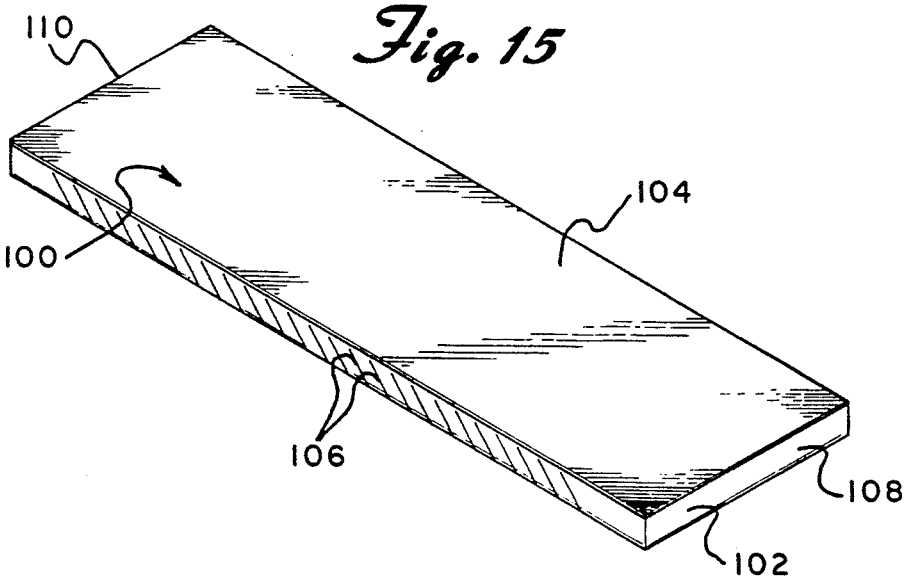
FIG. 15 is a perspective view of a panel of duct board cut using a method of the present invention.
Figure 16:
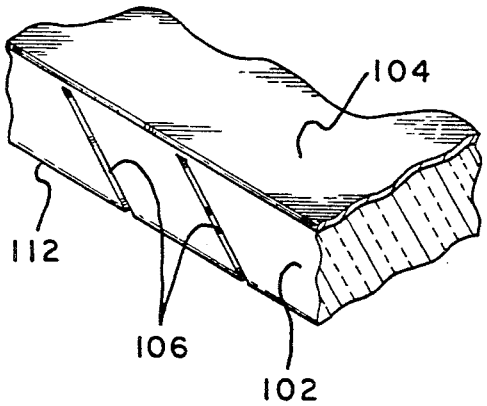
FIG. 16 is an expanded perspective view of a section of the cut board illustrated in FIG. 15.
Figure 17:
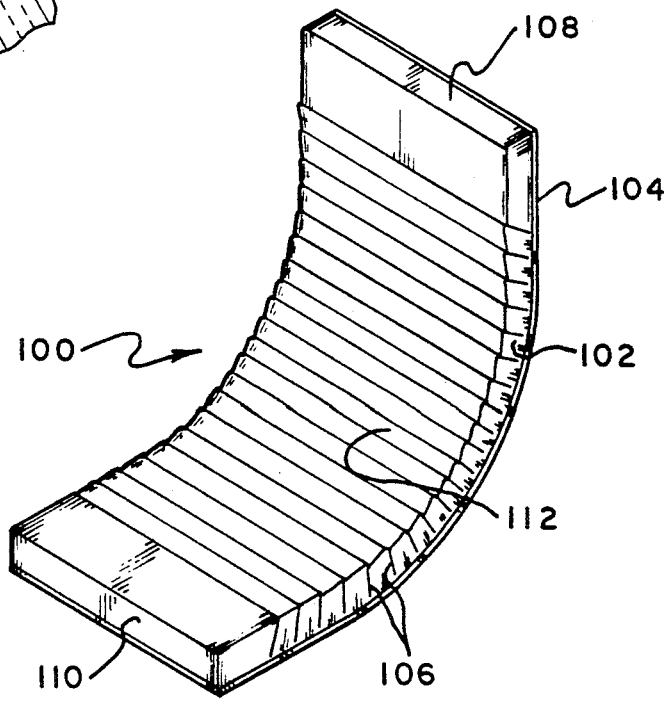
FIG. 17 is a perspective view of the panel illustrated in FIG. 15 bent to a ninety degree arc shape.

As shown in FIGS. 15 through 17, back panel 100 is prepared for forming by making transverse cuts 106 spaced one inch apart along the length of panel 100 from end 108 to end 110. Cuts 106 are made from the face 112 of panel 100 opposite to surface foil sheet 104 to a depth approaching that foil sheet but not cutting it. Each cut 106 is made at a forty-five degree angle to bottom surface 112. In FIG. 16, cuts 106 are shown in an expanded view cut from surface 112 toward foil sheet 104 essentially all the way through the thickness of panel material 102. Although the view shows a width to the cuts, they are only cuts and no significant material is removed. As illustrated in FIG. 17, panel 100 is now formed in a ninety degree arc by bending ends 108 and 110 together with foil surface 104 on the convex side of the panel and the openings of cuts 106 on the concave side. These cuts made with a sharp knife do not remove material and may range from about thirty degrees to about seventy degrees with surface 112. As the angle approaches thirty degrees, the cuts become too long and the ends of the material near surface 112 deteriorate. As the angle approaches seventy degrees, the effectiveness of the sliding movement along the cut lines is less effective.

While this invention has been described with reference to the specific embodiments disclosed herein, it is not confined to the details set forth and the patent is intended to include modifications and changes which may come within and extend from the following claims.

I claim:

1. A cutting apparatus to cut an arc shaped cut through a panel comprising:

(A) a cutting device comprising:

(i) an arm member comprising:

(a) a length having a first end and a second end, (b) a top surface facing upwardly.
(c) a bottom surface facing downwardly.
(d) a section of the arm member extending from the first end to a median position defining an upper plane of the bottom surface, and
(e) an end section of the arm member proximate the second end defining a lower plane of the bottom surface parallel to upper plane of the bottom surface, (ii) a pivot guide member depending downwardly from the bottom surface of the arm member,
(iii) cutting means detachably attached proximate the second end and defining a cutting edge depending downwardly from the bottom surface of the arm member,
(iv) a first gripping member extending upwardly from the upper surface of the arm member proximate the pivot guide member,
(v) fixing means to allow positioning the distance between the cutting means and the pivot guide member and the first gripping member along the length of the arm member at a chosen position and to releasably fix the chosen position, and
(vi) a second gripping member attached to the arm member and extending upwardly from the upper surface of the arm member proximate the second end, and (B) a guide device comprising:
(i) a block member comprising a top surface, and a bottom surface.
(ii) fastening means to fasten the block member to a top surface to the panel to prevent horizontal movement of the block relative to the panel,
(iii) a slot cut out from the top surface of the block member with a depth toward the bottom surface of the block member comprising:
(a) a first section of the slot extending from a first end of the first section of the slot to a second end of the first section of the slot, comprising a first straight line direction,
(b) a second section of the slot extending from a first end of the second section of the slot to a second end of the second section of the slot, comprising a second straight line direction perpendicular to and directed at the first straight line direction proximate the second end of the first section of the slot, and
(c) an intersecting section of the slot joining the second ends of the first and second sections of the slot,
wherein the slot has a width sufficient to receive the pivot guide member and allow the guide member to freely slide along the length of the slot from the first end of the first section to the first end of the second section,
wherein the first end of the arm member is free to move unimpeded horizontally.

2. The cutting apparatus of claim 1 wherein the fastening means comprises a plurality of pointed members attached to the block and depending downwardly from the bottom surface of the block member.

3. The cutting apparatus of claim 2 wherein the fastening means comprises a multiplicity of pointed metal spikes.

4. The cutting apparatus of claim 1 wherein the slot in the block member is "L" shaped.

5. The cutting apparatus of claim 1 wherein the intersecting section of the slot comprises a curved arc direction.

6. The cutting apparatus of claim 5 wherein the curved arc direction of the slot comprises a partial circle.

7. The cutting apparatus of claim 1 wherein the first straight line direction of the slot is parallel to an edge of the block member.

8. The cutting apparatus of claim 1 wherein the block member further comprises upper, lower, first side, and second side edges, and wherein the slot comprises:
(a) the first section of the slot extending from a point proximate the first side edge toward the second side edge, and parallel to the upper edge,
(b) the second section of the slot extending from a point proximate the lower edge toward the upper edge and parallel to the second side edge, and
(c) an arc section joining ends of the first and second straight line sections at median points along the upper edge and the second side edge.

9. A cutting apparatus to cut an arc shaped cut comprising:

(A) a cutting device comprising:
(i) an arm member comprising:
(a) a length having a first end and a second end,
(b) a top surface facing upwardly,
(c) a bottom surface facing downwardly,
(d) a section of the arm member extending from the first end to a median position defining an upper plane of the bottom surface, and
(e) an end section of the arm member proximate the second end defining a lower plane of the bottom surface parallel to upper plane of the bottom surface,
(ii) a pivot guide member depending downwardly from the bottom surface of the arm member,
(iii) a first gripping member extending upwardly from the upper surface of the arm member proximate the pivot guide member,
(iv) fixing means to allow positioning the pivot guide member and the first gripping member along the length of the arm member at a chosen position and to releasably fix the pivot guide member and the first gripping member at the chosen position,
(v) a second gripping member attached to the arm member and extending upwardly from the upper surface of the arm member proximate the second end, and
(vi) cutting means detachably attached proximate the second end comprising a cutting edge depending downwardly from the bottom surface of the arm member to make a line cut in a plane perpendicular to the bottom surface of the arm member and to the length of the arm member, and (B) a guide device comprising:
(i) a block member comprising a top surface, a bottom surface, an upper edge, a lower edge, a first side edge, and a second side edge,
(ii) a plurality of pointed members attached to the block and depending away from the bottom surface of the block member,
(iii) an "L" shaped slot cut out from the top surface of the block member with a width and with a depth toward the bottom surface of the block member, wherein the "L" shaped slot comprises two line directions that are perpendicular to each other and intersect at an apex of the slot, and wherein the width and depth of the slot are sufficient to receive the pivot guide member and allow the guide member to freely slide along the length of the slot from the first end of the first section to the first end of the second section, and wherein the first end of the arm member is free to move unimpeded horizontally.

10. The cutting apparatus of claim 9 wherein the fastening means comprises a multiplicity of pointed metal spikes.

11. The cutting apparatus of claim 9 wherein the slot comprises:

(a) a first straight line section extending from a point proximate the first side edge toward the second side edge, and parallel to the upper edge, (b) a second straight line section extending from a point proximate the lower edge toward the upper edge and parallel to the second side edge, and (c) an arc section joining ends of the first and second straight line sections at median points along the upper edge and the second side edge.

12. The cutting apparatus of claim 9 wherein the fixing means comprises:

(a) a slide slot cut through the arm member lengthwise along the arm member of sufficient width to receive a section to the pivot guide member, (b) a plate member positioned on the top surface of the arm member, wherein the first gripping member is rigidly attached to the plate member extending upwardly and the pivot guide member is rigidly attached to the plate member extending downwardly through the slide slot through the arm member, and (c) means to releasably fix the plate to the arm member to position the pivot guide member at the chosen position.

13. A method for cutting an arc shaped cut through a panel comprising:

(A) providing a cutting device comprising:

(i) an arm member comprising a length having a first end and a second end, a top surface facing upwardly, and a bottom surface facing downwardly, (ii) a pivot guide member depending downwardly from the bottom surface of the arm member, (iii) a first gripping member extending upwardly from the upper surface of the arm member proximate the pivot guide member, (iv) fixing means to allow positioning the pivot guide member and the first gripping member along the length of the arm member at a chosen position and to releasably fix the pivot guide member and the first gripping member at the chosen position, (v) a second gripping member attached to the arm member and extending upwardly from the upper surface of the arm member proximate the second end, and (vi) cutting means detachably attached proximate the second end comprising a cutting edge depending downwardly from the bottom surface of the arm member, and (B) providing a guide device comprising:

(i) a block member comprising a top surface, a bottom surface, an upper edge, a lower edge, a first side edge, and a second side edge, (ii) fastening means to fasten the block member to a top surface to the panel to prevent horizontal movement of the block relative to the panel, (iii) a slot cut out from the top surface of the block member with a depth toward the bottom surface of the block member comprising:

(a) a first section of the slot extending from a first end of the first section of the slot to a second end of the first section of the slot, comprising a first straight line direction, (b) a second section of the slot extending from a first end of the second section of the slot to a second end of the second section of the slot, comprising a second straight line direction perpendicular to and directed at the first straight line direction proximate the second end of the first section of the slot, and (c) an intersecting section of the slot joining the second ends of the first and second sections of the slot, wherein the slot has a width sufficient to receive the pivot guide member and allow the guide member to freely slide along the length of the slot, (C) placing the block member with the bottom surface facing downwardly toward the top of a panel to be cut, (D) exerting sufficient pressure on the block member to cause the fastening means to fasten to the panel, (E) placing the cutting device on top of the block member engaging the pivot guide member in the slot at the first end to the first section of the slot with the arm member positioned perpendicular to the first straight line direction, (F) grasping the first and second gripping members with the hands and moving the cutting device toward the second end of the first section while maintaining engagement of the pivot guide member in the first straight line section of the slot and while maintaining the arm member in perpendicular alignment to the first straight line section of the slot, (G) when the pivot guide member reaches the intersecting section of the slot, horizontally rotating the second gripping member toward the first end of the second straight section of the slot, while maintaining the pivot guide member in the intersecting section of the slot until the arm member is positioned perpendicular to the second straight line section of the slot, and (H) moving the first and second gripping members of the cutting device with the hands toward the first end of the second straight section of the slot while maintaining engagement of the pivot guide member in the second straight line section of the slot and while maintaining the arm member in perpendicular alignment to the second straight line section of the slot.

14. A cutting apparatus to cut an arc shaped cut through a panel comprising:

(A) a cutting device comprising:

(i) an arm member comprising a length having a first end and a second end, a top surface facing upwardly, and a bottom surface facing downwardly, (ii) a pivot guide member depending downwardly from the bottom surface of the arm member.

(iii) cutting means detachably attached proximate the second end and defining a cutting edge depending downwardly from the bottom surface of the arm member.

(iv) a first gripping member extending upwardly from the upper surface of the arm member proximate the pivot guide member, (v) fixing means to allow positioning the distance between the cutting means and the pivot guide member and the first gripping member along the length of the arm member at a chosen position and to releasably fix the chosen position, the fixing means comprising:

(a) a slide slot cut through the arm member lengthwise along the arm member of sufficient width to receive a section to the pivot guide member, (b) a plate member positioned on the top surface of the arm member, wherein the first gripping member is rigidly attached to the plate member extending upwardly and the pivot guide member is rigidly attached to the plate member extending downwardly through the slide slot through the arm member, and (c) means to releasably fix the plate to the arm member to position the pivot guide member at the chosen position, and (vi) a second gripping member attached to the arm member and extending upwardly from the upper surface of the arm member proximate the second end, and (B) a guide device comprising:

(i) a block member comprising a top surface, and a bottom surface.

(ii) fastening means to fasten the block member to a top surface to the panel to prevent horizontal movement of the block relative to the panel, (iii) a slot cut out from the top surface of the block member with a depth toward the bottom surface of the block member comprising:

(a) a first section of the slot extending from a first end of the first section of the slot to a second end of the first section of the slot, comprising a first straight line direction, (b) a second section of the slot extending from a first end of the second section of the slot to a second end of the second section of the slot, comprising a second straight line direction perpendicular to and directed at the first straight line direction proximate the second end of the first section of the slot, and (c) an intersecting section of the slot joining the second ends of the first and second sections of the slot, wherein the slot has a width sufficient to receive the pivot guide member and allow the guide member to freely slide along the length of the slot from the first end of the first section to the first end of the second section, wherein the first end of the arm member is free to move unimpeded horizontally.

* * * * *